US005204230A

United States Patent [19]

Hayashi

[11] Patent Number: 5,204,230

[45] Date of Patent: Apr. 20, 1993

[54] VACUUM PACKAGED PHOTOGRAPHIC PROCESSING COMPOSITION

[75] Inventor: Katsumi Hayashi, Odawara, Japan

[73] Assignee: Fuji Photo Film Co., Ltd., Kanagawa, Japan

[21] Appl. No.: 706,693

[22] Filed: May 29, 1991

[30] Foreign Application Priority Data

May 29, 1990 [JP] Japan ..... 2-138858

[51] Int. Cl.[5] ..... G03C 5/18; G03C 5/26

[52] U.S. Cl. ..... 430/450; 430/403; 430/464; 430/465; 430/466; 430/449; 206/524.8; 206/578

[58] Field of Search ..... 430/403, 464, 465, 466, 430/450, 449; 206/524.8, 578

[56] References Cited

U.S. PATENT DOCUMENTS 4,366,232 12/1982 Buser et al. ..... 430/462

4,770,979 9/1988 Koboshi et al. ..... 430/479

FOREIGN PATENT DOCUMENTS 0196551 10/1986 European Pat. Off. .

*Primary Examiner*—Charles L. Bowers, Jr.

*Assistant Examiner*—Geraldine Letscher

*Attorney, Agent, or Firm*—Sughrue, Mion, Zinn, Macpeak & Seas

[57] ABSTRACT

A vacuum package of a photographic processing composition consisting of a plurality of components is obtained by placing the components in a bag as separate solid state layers in a vacuum sealed manner. A normally liquid component is converted into a solid adduct in order to form a layer. A substantially water insoluble component or trace component is coated on the surface of particles of a water soluble inorganic compound, from which another layer is formed. The packaged composition is taken out of the bag and diluted with water to prepare a processing solution.

46 Claims, 1 Drawing Sheet

VACUUM PACKAGED PHOTOGRAPHIC PROCESSING COMPOSITION

This invention relates to a vacuum package of a photographic processing composition from which a solution for processing photographic silver halide photosensitive material (to be simply referred to as photosensitive material) is prepared on use.

BACKGROUND OF THE INVENTION

Black-and-white photosensitive materials, after exposure, are processed through a series of steps of black-and-white development, fixation, washing and the like while color photosensitive materials, after exposure, are processed through a series of steps of color development, desilvering, washing, stabilization, and the like. There are utilized a black-and-white developer for black-and-white development, a fixer for fixation, a color developer for color development, a bleaching solution, bleach-fixing solution, and fixer for desilvering, city water or ion-exchanged water for washing, and a stabilizer for stabilization. The photosensitive materials are processed by dipping them in the respective processing solutions which are usually adjusted to a temperature of about 30° to 40° C. Since the processing solutions lower their processing ability upon repetition of processing and with the lapse of time, it is a common practice to replace the respective solutions by fresh solutions partially or entirely in a replenishing or batch-wise mode.

Prior to the start of processing operation, the user has to prepare some processing solutions. Most chemical agents used for such preparation are solid and if kept in contact, can react with one another to form undesirable reaction products. It is not recommended to deliver a mixture of chemical agents to the user. Therefore, interactive chemical agents are received in separate packages which are delivered to the user. Separate packaging increases the costs for packages and transportation and leaves the possibility that unskillful users wrongly blend the chemical agents.

It is a common practice to separate the components of a processing solution into two or more parts and deliver the respective parts in concentrate form to the user so that dilution is the only operation that the user has to take in preparing a processing solution. For example, a black-and-white developer is often available as two concentrate parts, a first part containing a developing agent and an alkaline agent and a second part containing a hardener or as three concentrate parts using a third part containing an auxiliary developing agent in addition to similar first and second parts. A fixer is often available as two concentrate parts, a first part containing a hardener and a second part containing the remaining components. Although these parts are concentrates, they are received in separate containers if they contain interactive components. This system is not fully compact in this sense. In addition, since the concentrate parts are liquid, they require a dilution step prior to their preparation, need careful handling during transportation, and allow formation of deposits during transportation or storage which are often difficult to dissolve again.

European Patent Application Publication No. 196551 discloses a new approach in which two or more interactive particulate components among components of a photographic processing composition are stacked as layers through an inert layer so as to prevent their reaction and vacuum packaged. This publication sets forth an example using a black-and-white photographic developing composition.

The components to which this approach is applied should be of solid powder form although it is sometimes inevitable to use a liquid component. Examples of the liquid compound include aminophenols used as an auxiliary developing agent, alkanolamines used as a development promoter or preservative, and aldehydes used as a hardener.

Therefore, where the use of a liquid component is inevitable, it must be accommodated in a separate container in addition to the package, resulting in an increased number of containers against the demand for compactness. A set of a liquid bottle and a solid package leaves the possibility that the user forget to add the bottle contents. Due to the liquid nature, there remain problems of leakage, degradation with time, and spillage upon addition. Some liquid components are likely to evaporate off. These factors can lead to preparation of a solution which is improper to produce images of satisfactory photographic nature.

The above-cited European publication does not suggest the best mode of layer stacking for a fixing composition which belongs to the photographic black-and-white processing compositions.

The above-mentioned problems commonly occur in any type of photographic processing compositions.

SUMMARY OF THE INVENTION

An object of the present invention is to provide a vacuum package of a photographic processing composition which is compact in shape, easy to handle, and ready to prepare a uniform solution therefrom consistently through simple operation and has a sufficient storage life to provide the solution with satisfactory photographic activities on actual use.

The present invention provides a vacuum package of a photographic processing composition comprising a plurality of components. The components are received in a container as separate solid state layers in a vacuum sealed manner. A normally liquid component of the composition, that is, a component which is liquid at room temperature and atmospheric pressure is converted into a solid adduct for containment. In another embodiment, particles of a water soluble inorganic compound are coated on the surface with a substantially water insoluble component or trace component prior to formation of a layer.

The invention is applicable to a black-and-white developing composition comprising an alkaline agent, a preservative, a developing agent, and a chelating agent which are stacked as respective layers in the described order. Often, the normally liquid component is a carbonyl compound which is converted into a solid adduct with a sulfite or an amine compound which is converted into a solid adduct with an acid. Preferably, an inert layer intervenes between layers of interactive components. The invention is also applicable to a fixing composition.

According to the present invention, the components of a photographic processing composition are received in a container as layers each consisting of a different component from the other layers in principle, and the container is vacuum sealed to provide a single compact vacuum package containing all the components in a solid state layered arrangement. The vacuum packaging eliminates the risk of intermixing of the components because the tightly compacted layer structure retains the respective layers intact.

According to the present invention, the carbonyl compounds (such as aldehydes and ketones) and amine compounds which are liquid additives by nature are converted into solid adducts using sulfite salts and acids, respectively. Conversion of a liquid component into a solid or powder component allows it to be incorporated as a layer component of the layer structure. All the necessary components are available as an integral layered arrangement or block. The all solid system not only avoids the problems of lapse of addition, leakage from the container, spillage upon addition, and possible change in composition due to evaporation, which would occur with the prior art solid/liquid system using a separate container filled with a liquid component, but also is excellent in shelf stability and easy to handle. Consistent processing performance is available from a solution which is prepared from the layered arrangement after storage.

In the preferred embodiment of the laminate, a solid component which can react with another solid component if kept in contact is stacked apart from the other component via an intervening layer. No loss of processing activity occurs after storage of the laminate over a long period of time.

Preparation of a processing solution is quite easy because the user is only required to take out the layer structured composition from the vacuum package and dissolve it in a predetermined volume of water. A processing solution prepared from the packaged composition is effective in processing photosensitive material to produce images with better photographic properties.

BRIEF DESCRIPTION OF THE DRAWING

The structure, operation and advantages of the presently preferred embodiment of this invention will become further apparent upon consideration of the following description, taken in conjunction with the accompanying drawing, wherein.

the only FIGURE.

DETAILED DESCRIPTION OF THE INVENTION

Figure 1:
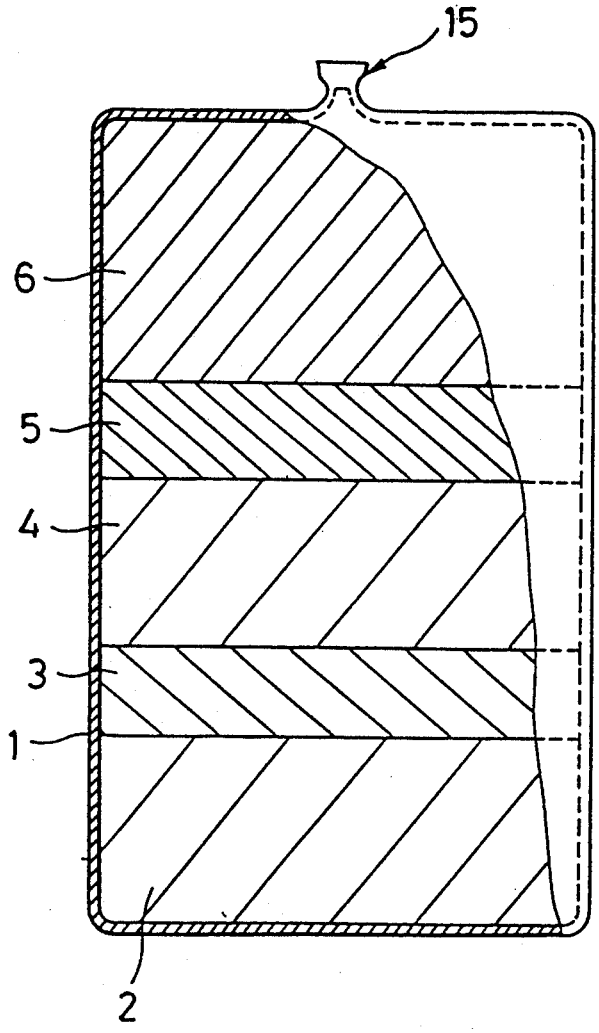
FIG. 1 is a partially cross sectional elevation of a developer composition vacuum package according to the present invention.

The vacuum packaged photographic processing composition of the present invention consists of a plurality of components, which are received in a container 1 as a plurality of distinct layers 2, 3, 4, 5, and 6 as shown in FIG. 1. The container is sealed under vacuum such that the pressure in the sealed container is less than the atmospheric pressure, resulting in a vacuum package of generally columnar shape. Although five layers are shown in the FIGURE, the number of layers is not limited thereto.

The container 1 used herein is of any desired material which can withstand vacuum packaging and does not react with the components of the processing composition upon contact. Preferred examples include resins such as polyethylene, polypropylene, nylon, vinylidene chloride, and polyethylene terephthalate and aluminum and other metal foils surface coated with such resins.

The pressure within the container may be up to 100 mmHg, preferably 50 to 1 mmHg, more preferably 30 to 1 mmHg after sealing. The vacuum can avoid any influence of oxygen and moisture on the processing composition.

A package is obtained by supplying a selected component into a container 1 through an inlet 15 to form a bottom layer 2 of uniform thickness, and stacking subsequent layers in the same manner, and vacuum sealing the container in a well-known manner, for example, by heat sealing the inlet 15. Vibration may assist in introducing shots into the container. As a result of vacuum packaging, the respective layers 2, 3, 4, 5 and 6 define distinct interfaces with adjacent layers and form a somewhat rigid integral structure as a whole. Little or no mutual diffusion of the components between the adjacent layers with time occurs and, if any does occur, it occurs to a negligible extent from the point of view of photographic performance.

According to the present invention, at least one layer of the laminate or layer arrangement contains a normally liquid component which has to be converted into a solid adduct.

This component is converted into a solid or powder form by forming an adduct though it is otherwise liquid, that is, liquid in forms other than adduct, so that it cannot be stacked as such. The processing composition often uses a substantial amount of this component.

By the term "adduct" is meant a substance resulting from association of two types of molecules in a certain way.

In the case of a black-and-white developer, the normally liquid compounds include carbonyl compounds, for example, aldehydes and ketones such as formaldehyde, glutaraldehyde, acetoaldehyde, acetone, etc. as well as amine compounds.

The compounds which are used to form adducts with the carbonyl compounds for converting the carbonyl compounds into powder form may be sulfite salts inclusive of bisulfites which are often used as a preservative. Examples of the sulfite include alkali metal sulfites and ammonium sulfite, for example, $NaHSO_3$, $KHSO_3$, $(NH_4)_2SO_3$, etc. Usually, the carbonyl compounds and the sulfites form adducts in a molar ratio of from 1:1 to 3:1. For the formation of adducts, any well-known method may be used as described in J. Zabicky, The Chemistry of the Carbonyl Group, Vol. 2, page 33, Interscience Publishers, London, 1970, and J. F. Walker, Formaldehyde, page 177, Reinhold Publishing Corp., N.Y., 1953.

Adducts of carbonyl compounds with sulfites will dissociate in water or processing solution into the respective compounds which perform their own function.

The adduct may be introduced into any desired layer, preferably a layer which serves as an inert layer intervening between two layers in the layer arrangement for prohibiting solid phase reaction therebetween as will be described later.

It should be understood that the adduct can form a layer singly or be combined with another component or components to form a layer. In the latter case, the adduct may be added to a layer containing a sulfite. Alternatively, the adduct may be used instead of a sulfite.

The normally liquid amine compounds include alkanol amines such as diethanolamine, N-butylethanolamine, methylaminoethanol, 3-diethylamino-1,2-propane diol, and dimethylaminohexanol; aminophenols such as p-aminophenol and N-(4-hydroxyphenyl)glycine; and hydroxylamines as described in Japanese Patent Application Kokai (JP-A) No. 106244/1981 and European Patent Application Publication No. 0136582.

The compounds which are used to form adducts with the amine compounds for converting the amine compounds into powder form may be organic acids such as Lewis acids and inorganic and organic acids. Inorganic acids include hydrochloric acid, nitric acid, sulfuric acid, and phosphoric acid. Organic acids include carboxylic acids such as oxalic acid and succinic acid, and sulfonic acids such as p-toluenesulfonic acid. These acids are not always requisite additives of the processing composition, but are rather used only for the powdering purpose. Usually, the amine compounds and the acids form adducts in a molar ratio of from 2:1 to 1:2. For the formation of adducts, any well-known method may be used as described in S. Patai, The Chemistry of the Amino Group, page 195, Interscience Publishers, London (1968).

Several illustrative, non-limiting examples of the adduct are given below.

A) Carbonyl compounds
1) formaldehyde-$NaHSO_3$
2) glutaraldehyde-$NaHSO_3$
3) acetone-$NaHSO_3$
4) acetoaldehyde-$KHSO_3$ B) Amine compounds
1) p-aminophenol-HCl
2) diethanolamine-$HNO_3$
3) N-butyldiethanolamine-$(COOH)_2$
4) 6-dimethylamino-1-hexanol-succinic acid
5) methylaminoethanol-HCl
6) N-methylaminophenol-$H_2SO_4$ Also useful are addition salts of amine compounds with $SO_2$ and polyethylene glycol.

For the fixer which is used in combination with the black-and-white developer, acetone is typical of normally liquid compounds to be converted into powder.

By converting a normally liquid compound into an adduct which is in powder form, the complexity associated with the use of a separate container filled with the liquid compound is avoided with the attendant ease of handling.

In fabricating a layer arrangement according to the present invention, the following procedure may be employed in order to improve the handling of powder components.

A compound which is used in a black-and-white developer and available in fine powdery form, for example, a UV absorber is preferably granulated because granules avoid powder scattering and are readily dissolved in water. Granulation may be effected by well-known methods such as spray drying. An alkaline agent such as LiOH is preferably converted into a mixed molten salt with NaOH or KOH in order to prevent scattering. Formation of a mixed molten salt of LiOH with NaOH or KOH has an additional benefit ascribed to reduced deliquescence that its handling is easier than the use of these alkaline agents as such.

Water-soluble polymers such as hydroxyethyl cellulose and carboxymethyl cellulose which are used as a thickener in the black-and-white developing and fixing compositions are preferably premixed with readily soluble inorganic compounds such as sulfites and carbonates. Such a premix is more readily soluble in water in diluting the composition with water, avoiding the formation of agglomerates.

In the practice of the invention, a substantially water insoluble compound or an additive to be added in a minor amount may be introduced into a layer as being coated on the surface of particles of a highly water soluble compound.

Interactive components of the processing composition, that is, components which can give rise to solid phase reaction if they are kept in contact in solid state, are stacked such that they are out of contact. Differently stated, an inert layer of a compound which does not react with the interactive components intervenes between the layers of the interactive components.

The inert layer is composed of an inert component which may be selected from the components of the processing composition. If an inert component is not found in the processing composition or, if one is found, but, its amount is too small to solely form an inert layer, any appropriate inert compound which does not alter photographic properties and is otherwise unnecessary in the processing composition may be selected to form an inert layer.

There has been described a layer arrangement having a layer of a powder component which is converted from a normally liquid component by forming an adduct thereof as well as layers of other components. Now, the application of the layer arrangement to a black-and-white developing composition is described.

In general, the black-and-white developing composition is mainly comprised of a developing agent, an alkaline agent, a preservative, and a developing retarder or antifoggant and if necessary, other optional additives. In order to obtain a layer arrangement using these components, they should be of solid powder.

Those components which can give rise to a solid phase reaction if they are kept in contact in solid state are stacked such that they are separated by another inert layer as previously described. Such interactive components which should be kept apart are typically a developing agent and an alkaline agent.

The black-and-white developing agent is mainly composed of a hydroquinone while combinations of a hydroquinone with a 1-phenyl-3-pyrazolidone or p-aminophenol compound are often used for better performance. Ascorbic acid is also a useful developing agent. Among these developing agents, hydroquinones should preferably be kept apart from the alkaline agent.

Auxiliary developing agents such as 1-phenyl-3-pyrazolidones and p-aminophenols are somewhat stable to the alkaline agent although they should also preferably be kept apart from the alkaline agent.

Some of p-aminophenols are liquid. Such a liquid component must be converted into a powder by forming an adduct thereof according to the teaching of the invention before it can be incorporated as a solid state layer.

Alkaline compounds include carbonates, borates and phosphates of alkali metals as well as the alkaline agent.

A layer containing a developing agent is often a layer consisting of a developing agent or agents. Most often two developing agents including an auxiliary developing agent are used. Two developing agents may be used as a mixture to form a single layer or separately to form respective layers. Separate layers of respective developing agents are typically used while a layer of a 1-phenyl-3-pyrazolidone auxiliary developing agent and a layer of a sulfite preservative are stacked in contact arrangement.

In stacking layers, the order of admitting respective components into a bag or container is not particularly limited insofar as a layer arrangement can be obtained. Preferably, an alkaline agent is introduced first for the following reason. When the package is used by cutting the bag on one side, taking the layer arrangement out of the bag, and dissolving it in a predetermined amount of water, it is convenient to introduce the layer arrangement into water from the side of a water softener or chelating agent layer. Location of an alkaline agent as the bottom layer allows for such desirable layer arrangement.

In a preferred embodiment, the layer arrangement of the invention is obtained by stacking an alkaline agent, a preservative, a developing agent, and a water softener or chelating agent in this order from the bottom to the top layer. It is acceptable to divide the same compound into two or more parts which are added to separate layers.

In the vacuum packaged layer arrangement of the black-and-white developing composition, each layer has a thickness corresponding to the amount of its component necessary to prepare a single charge of black-and-white developer.

Respective components of the black-and-white developing composition are described in detail. Where quantity is referred to, it is the quantity required on use as a black-and-white developer.

The developing agents, which are generally used in combination of two or more as previously described, include hydroquinone developing agents such as hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, with hydroquinone being most preferred.

Also useful are p-aminophenol developing agents, for example, N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol (inclusive of liquid ones), with the N-methyl-p-aminophenol being most preferred.

Examples of the 3-pyrazolidone developing agent include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

Generally, the hydroquinone developing agent is used in an amount of 0.01 to 1.5 mol/liter, preferably 0.05 to 1.2 mol/liter. In addition, the p-aminophenol or 3-pyrazolidone developing agent is used in an amount of 0.0005 to 0.2 mol/liter, preferably 0.001 to 0.1 mol/liter. Ascorbic acid and derivatives thereof are also useful as the developing agent.

Examples of the sulfite preservative include sodium sulfite, potassium sulfite, lithium sulfite, ammonium sulfite, sodium bisulfite, and potassium metabisulfite. The sulfite is preferably used in an amount of at least 0.2 mol/liter, more preferably 0.4 to 2.5 mol/liter.

The alkaline agents used for pH adjustment include sodium hydroxide, potassium hydroxide, sodium carbonate, potassium carbonate, sodium tertiary phosphate, and potassium tertiary phosphate. Also useful are buffer agents, for example, borates as disclosed in JP-A 186259/1987, saccharose, acetoxime, and 5-sulfosalicylic acid as disclosed in JP-A 93433/1985, phosphates, and carbonates. With these agents, the black-and-white developer is preferably adjusted to pH 8.5 to 13, especially pH 9 to 12.

Useful hardeners are aldehydes which are converted into powder form by forming an adduct thereof with a bisulfite according to the teaching of the present invention. The hardener is used in an amount of about 1 to about 30 grams/liter.

The antifoggant or development retarder includes mercapto compounds such as 1-phenyl-5-mercaptotetrazole, indazoles such as 5-nitroindazole, and benzotriazoles such as 5-methylbenzotriazole.

Amine compounds such as alkanolamines as described in JP-A 106244/1981 and EP Publication No. 0136582 are used in powder form by forming adducts thereof and in an amount of about 0.5 to about 40 grams/liter.

Also useful are development promoters as disclosed in Research Disclosure, Vol. 176, No. 17643, item XXI (December 1978), and color toning agents, surfactants, defoaming agents, water softeners if necessary, and antisludging agents as disclosed in JP-A 24347/1981 and JP-B 46585/1981, as well as additives as described in L. F. A. Mason, Photographic Processing Chemistry, Focal Press, 1966, pages 226–229, U.S. Pat. Nos. 2,193,015 and 2,592,364, and JP-A 64933/1973. Among these additives, solid ones can be components for forming layers of the laminate.

If it is inevitable to add a liquid compound which can be converted into powder form by no means, it is received in a separate container. Typical of the liquid component are organic solvents including ethylene glycol, diethylene glycol, triethylene glycol, dimethylformamide, methyl cellosolve, hexylene glycol, ethanol, and methanol.

Next, the application of the layer arrangement having an adduct integrated therein to other processing composition is described.

Where the layer arrangement is applied to a fixing composition, for example, a layer of a thiosulfate fixing agent is stacked apart from a layer of a hardener. A sulfite used as a preservative for the fixing agent should also be stacked apart from the hardener. As in the black-and-white developing composition, an inert layer can intervene between such layers which are desirably spaced apart from each other.

The fixing composition is diluted with water to form a fixer. In general, the fixer is an aqueous solution containing a thiosulfate or thiocyanate as the fixing agent at pH 3.8 or higher, preferably pH 4.2 to 7.0.

The fixing agents include sodium and ammonium thiosulfates and thiocyanates, with the ammonium thiosulfate being most preferred in view of fixing rate. The fixing agent may be used in varying amounts, often in an amount of about 0.1 to about 3 mol/liter.

The fixer may contain a water soluble aluminum salt effective as a hardener, for example, aluminum chloride, aluminum sulfate, and potassium alum. The aluminum salt is added in an amount of 0 to 2 grams/liter of Al.

Further, the fixer may contain tartaric acid, citric acid, gluconic acid, and derivatives thereof alone or in admixture of two or more. These acids and acid derivatives are used in an amount of at least 0.005 mol/liter, preferably 0.01 to 0.3 mol/liter.

If desired, the fixer may contain preservatives (e.g., sulfites and bisulfites), pH buffer agents (e.g., acetic acid and boric acid), pH adjusting agents (e.g., sulfuric acid), chelating agents capable of softening hard water, and such compounds as disclosed in JP-A 78551/1987. Among these additives, solid ones can be components for forming layers of the layer arrangement.

It is effective to stabilize a component before incorporating in the layer arrangement of the present invention. For example, sodium hydroxide and potassium hydroxide used as the alkaline agent may be ones stabilized by coating them with phthalic anhydride as described in U.S. Pat. Nos. 2,649,376 and 2,639,221.

For other components of respective layers of the layer arrangement according to the present invention, there may be used various stabilizing methods, for example, stabilization of developer components using alkali metasulfites, phthalic anhydride, maleic anhydride, benzoic acid, salicylic acid, phthalimide or the like as disclosed in U.S. Pat. No. 2,384,592;

stabilization of developer components using $B_2O_3$ (boric anhydride) as disclosed in U.S. Pat. No. 2,606,118;

stabilization of developer components using boric anhydride combined with phthalic anhydride as disclosed in U.S. Pat. No. 2,666,702;

stabilization of developer components using metaboric acid as disclosed in U.S. Pat. No. 2,666,703;

stabilization of developer components using delta-glucolactone as disclosed in U.S. Pat. No. 2,666,716; and stabilization of developer components using metaboric acid hydrates stabilized with phthalic anhydride, boric anhydride, metaboric acid or the like as disclosed in U.S. Pat. No. 2,685,513.

In the fixing composition, ammonium thiosulfate used as a fixing agent may be one prepared according to JP-B 16948/1967.

The present invention may be applied to any processing solutions other than the developer and fixer, for example, a rinsing solution and a stabilizing solution.

On use, the vacuum packaged processing composition of the invention is diluted with water to form a black-and-white developer or fixer which can be used in processing a variety of photographic black-and-white photosensitive materials including ordinary picture-taking negative films and black-and-white print papers, laser printer photographic materials and printing photosensitive materials, medical direct radiographic photosensitive materials, medical photofluorographic photosensitive materials, photosensitive materials for recording CRT display images, and industrial X-ray photosensitive materials.

The present invention is applicable to either one or both of the developer and the fixer.

After development and fixation, the silver halide photosensitive material is to be processed with wash water or stabilizer which is replenished at a flow rate of up to 3 liters per square meter of the photosensitive material (inclusive of 0, that is, pool water washing).

In the case of water-saving washing or non-piping washing, wash water or stabilizer should preferably be provided with antifungal means.

For development, the developing time generally ranges from 5 seconds to 3 minutes, preferably from 8 seconds to 2 minutes while the temperature ranges from 18° to 50° C., preferably from 20° to 40° C.

For fixation, the fixing time generally ranges from 5 seconds to 3 minutes at a temperature of about 18° to 50° C., preferably from 6 seconds to 2 minutes at a temperature of about 20° to 40° C.

For water washing or stabilization, the washing or stabilizing time generally ranges from 6 seconds to 3 minutes at a temperature of about 0° to 50° C., preferably from 6 seconds to 2 minutes at a temperature of about 10° to 40° C.

Having finished development, fixation and washing (or stabilization), the wash water is removed from the photosensitive material, that is, squeezed of water through squeeze rollers and then dried. Drying is generally at about 40° to 100° C. The drying time may vary with the ambient condition, usually in the range of from 5 seconds to 3 minutes, preferably from 5 seconds to 2 minutes at 40° to 80° C.

The vacuum packaged photographic processing composition having incorporated therein an adduct according to the present invention is effective not only for black-and-white photosensitive materials as mentioned above, but also for color photosensitive materials, for example, as a color developing composition, bleaching composition, bleach-fixing composition or fixing composition with equivalent results.

Some embodiments which are advantageously used in combination with the present invention will be described in detail.

In one embodiment, an intermediate layer composed of an inert substance intervenes between layers of components which are reactive with each other (interactive components).

For a black-and-white developing composition comprising a developing agent, alkaline agent, preservative, development retarder or antifoggant and other additives, the solid, but interactive components are typically developing agents and alkaline agents. As previously described, combinations of a hydroquinone with a 1-phenyl-3-pyrazolidone or p-aminophenol compound are often used as developing agents. Among the developing agents, hydroquinones are reactive even with weakly alkaline sulfite preservatives having a reducing power. In turn, 1-phenyl-3-pyrazolidone or p-aminophenol auxiliary developing agents are relatively stable to alkaline compounds, but can still interact with alkaline compounds.

In general, acidic compounds and alkaline compounds are interactive as well as compounds having a reducing power and compounds having an oxidizing power. The alkaline compounds include alkaline agents, pH buffer agents such as carbonates and borates, and sulfite preservatives. Sulfite salts will decompose upon contact with acids, giving off sulfur dioxide gas. Further, some dyes will discolor upon contact with sulfites.

The inert substance of the intermediate layer which is interposed between such interactive component layers should meet the requirements that (1) it does not function as a component of the photographic processing composition, that is, is not a component of the photographic processing composition, (2) it is inert to the components of the composition, especially to the components of the layers adjoining the intermediate layer, and (3) it does not substantially alter the photographic capability of a processing solution obtained by diluting the composition with water (the inert substance may or may not be dissolved in the solution).

Examples of the inert substance include saccharides such as glucose, inorganic salts such as NaCl, KCl, and $Na_2SO_4$, and water-soluble polymers such as hydroxyethyl cellulose. The intermediate layer may be composed of one or more of these inert substances (mixing or lamination). The inert substance which can be used is not limited to the foregoing examples, and insoluble substances in powder or bead form, for example, various glasses, ceramics such as alumina and silica, and resins such as expanded polyethylene may also be used. Where such insoluble substances are used, it is sometimes necessary to remove and recover the insoluble substances prior or subsequent to introduction of the processing composition into the processing tank. Hollow beads are easy to recover because they float on the solution. The insoluble substance may be recovered by filtration through a filter.

In view of requirements (1) and (3), the inert substance can be selected and determined with respect to amount (or layer thickness) and a number of layers sufficient to suppress the reaction between the interactive components on opposite sides of the intermediate layer, without taking into account the function as a component of the photographic processing composition. The prevention of deterioration of the processing composition with time is significantly improved over the prior art. Preferably, the intermediate layer has a sufficient thickness to prevent any contact between the interactive components on opposite sides of the intermediate layer.

Interposition of the intermediate inert layer allows for the use of an inexpensive compound which is restricted in use in the prior art in view of stability (e.g., 1-phenyl-3-pyrazolidone), eliminating restrictions on the processing composition formulation design.

In the preferred layer arrangement for a black-and-white developing composition, an intermediate layer intervenes between a layer containing an alkaline agent and a layer containing a developing agent. Differently stated, the intermediate layer partitions the layer arrangement into two regions. Either region can include a plurality of layers or be a single layer formed of a mixture of components.

Where a plurality of layers are provided on one side of the intermediate layer, for example, a strongly alkaline component should preferably be disposed most remote from the intermediate layer and a less alkaline component disposed nearer to the intermediate layer. More particularly, a layer of an organic acid such as aminopolycarboxylic acids, organic phosphonic acids and phosphonocarboxylic acids should preferably be disposed most remote from the intermediate layer and a layer of a developing agent such as hydroquinone disposed remote from the intermediate layer.

A layer of a sulfite preservative is generally disposed on the side of a developing agent-containing layer. No particular limit is imposed insofar as the sulfite preservative layer is disposed so as not to contact the hydroquinones. Most often, the sulfite preservative layer is disposed adjacent the inert layer.

The developing agent containing layer is preferably a layer consisting of a developing agent or agents. Usually, two developing agents including an auxiliary developing agent are used. Either a single layer of a mixture of developing agents or separate layers of respective developing agents are acceptable. Often, there are provided two separate layers. Among them, a layer of a 1-phenyl-3-pyrazolidone auxiliary developing agent may be stacked close to a sulfite layer.

It is also possible to provide a sulfite preservative layer on the side of an alkaline agent-containing layer since the generation of sulfur dioxide gas resulting from contact with an acid is prevented.

Development retarders or antifoggants are nearly neutral, including alkali metal halides such as sodium bromide, potassium bromide and potassium iodide; mercapto compounds such as 1-phenyl-5-mercaptotetrazole and sodium 2-mercaptobenzimidazole-5-sulfonate; indazole compounds such as 5-nitroindazole; and benzotriazole compounds such as 5-methylbenzotriazole; pH buffer agents such as salts of organic acids; and hardeners such as glutaraldehyde-sulfite addition salt. Such neutral compounds may be disposed on either the developing agent-containing layer side or the alkaline agent-containing layer side. In either case, a layer containing a neutral substance is disposed nearer to the intermediate layer.

It is also possible to form the intermediate layer from a mixture of a neutral substance (a component) and an inert substance (not a component) as defined above. In forming the intermediate layer of such a mixture, the thickness of the intermediate layer is preferentially determined and the inert substance which is a major component of the intermediate layer is added to and mixed with the necessary amount of the neutral substance until the total amount reaches the predetermined thickness. The inert substance is an extender in this sense.

In addition to the use of a single intermediate layer partitioning the layer arrangement into a developing agent-containing layer side and an alkaline agent-containing layer side, a plurality of intermediate layers may be used. For example, an intermediate layer may be disposed between each pair of adjacent layers each consisting of a different component.

The order of admitting respective components into a bag or container to stack layers is not particularly limited insofar as a layer arrangement can be obtained. Preferably, an alkaline agent is introduced first and a water softener or chelating agent last for the following reason. When the package is used by cutting the bag, taking the layer arrangement out of the bag, and dissolving it in a predetermined amount of water, it is convenient to introduce the layer arrangement into water from the side of a water softener or chelating agent layer. Location of an alkaline agent as the bottom layer allows for such desirable layer arrangement.

It is acceptable to divide the same compound into two or more parts which are added to separate layers.

In the vacuum packaged layer arrangement of the black-and-white developing composition, each layer has a thickness corresponding to the amount of its component necessary to prepare a single charge of black-and-white developer.

Components of a processing composition are generally available in powder or particle form, often having a particle size of 20 to 1000 μm (though not limited thereto). Often certain components are granulated or finely pulverized in order to enhance solubility in water. Granulation may be effected by well-known methods such as spray drying, and fine pulverization effected by milling or other well-known methods.

In another embodiment, at least one component of the composition is introduced in a layer by coating particles of a water soluble inorganic compound on the surface therewith. Differently stated, at least one layer of the layer arrangement is formed of particles of a water soluble inorganic compound coated on the surface with another component.

The soluble compound is a compound having a solubility of at least several grams/100 ml, preferably at least 10 grams/100 ml of water. Examples of the soluble compounds which are used in black-and-white processing compositions include alkali metal halides such as KBr, NaBr, KCl and KI used as an antifoggant or development retarder; alkali metal sulfites, bisulfites and metabisulfites such as $Na_2SO_3$, $K_2SO_3$, $NaHSO_3$, and $K_2S_2O_5$ used as a preservative; alkali metal carbonates and bicarbonates such as $Na_2CO_3$, $K_2CO_3$ and $NaHCO_3$ used as a pH buffer agent; alkali metal phosphates and hydrogen phosphates such as $Na_2HPO_4$, $KH_2PO_4$ and $Na_3PO_4$; and boric acid.

The compounds which are coated to the surface of particles include substantially water insoluble compounds and trace additives.

The substantially insoluble compound is a compound having a solubility of up to 0.1 gram/100 ml of water. Examples of the substantially insoluble compounds which are used in black-and-white processing compositions include mercapto compounds such as 1-phenyl-5-mercaptotetrazole, 2-amino-5-mercapto-3,4-thiazole, 2-mercaptobenzothiazole, and 2-amino-5-mercapto-1,2,4-thiadiazole; indazole compounds such as 5-nitroindazole and 6-nitroindazole; and benzotriazole compounds such as 5-methylbenzotriazole, benzotriazole, and 5-chlorobenzotriazole used as an antifoggant.

Another group of substantially insoluble compound are dyes which are used for the purpose of coloring to impart visual discrimination to a solution, for example, triphenylmethane dyes and Tartrazine.

Also exemplary are fluorocarbons used as a defoaming agent; Whitex 3B (Sumitomo Chemical K.K.) and Leucophor B (Sandaz) used as a brightener; pyrazolidone derivatives such as 1-phenyl-3-pyrazolidone, 1-phenyl-4,4-dimethyl-3-pyrazolidone, 1-phenyl-4-methyl-4-hydroxymethyl-3-pyrazolidone, and 1-tolyl-4-methyl-4-hydroxymethyl-3-pyrazolidone used as an auxiliary developing agent.

The trace additives are those to be added in minor amounts of up to 0.3% by weight based on the total weight of a black-and-white developing composition. They may be either soluble or insoluble in water since their water solubility is not a consideration.

Examples of the trace additive include mercapto compounds such as sodium 2-mercaptobenzimidazole-5-sulfonate as disclosed in JP-A 24347/1982 and 3,3'-dithiobisdihydrocinnamic acid and 3-(5-mercaptotetrazole)benzenesulfonic acid used as an antifoggant or development retarder; and alkali metal iodide such as KI. Also included are polyethylene compounds such as PEG 4000 used as a surfactant.

A soluble compound and a compound to be coated thereon may be properly selected in any desired combination from the respective groups. Since a soluble compound and a coating compound are brought in contact, a combination that can offset their functions should be avoided. Such undesirable combinations are combinations of compounds which should be kept apart in the layer arrangement as previously described.

Desirable combinations include a combination of compounds both having a common antifogging or development retarding function, a combination of an alkaline agent and an alkali soluble compound, and a combination of an acidic compound and an alkali decomposing compound. Exemplary desirable combinations are given below.

Combination A)

| Soluble compound | Insoluble compound |
|---|---|
| (1) KBr | 1-phenyl-5-mercaptotetrazole |
| (2) KBr | 5-methylbenzotriazole |
| (3) KBr | 5-nitroindazole |
| (4) $H_3BO_3$ | 5-nitroindazole |
| (5) $Na_2CO_3$ | 2-mercaptobenzothiazole |
| (6) $Na_2SO_3$ | benzotriazole |

-continued

Combination B)

| Soluble compound | Trace additive |
|---|---|
| (1) KBr | KI |
| (2) $Na_2CO_3$ | sodium 2-mercaptobenzimidazole-5-sulfonate |
| (3) $Na_2B_4O_7$ (borax) | sodium 2-mercaptobenzimidazole-5-sulfonate |
| (4) $H_3BO_3$ | 3-(5-mercaptotetrazole)-benzenesulfonic acid |

Other examples include anhydrous sodium sulfite coated with benzotriazole as disclosed in JP-B 13935/1981 and sodium sulfite, sodium bisulfite or sodium citrate coated with a coloring layer as disclosed in Japanese Utility Model Publication No. 51160/1978.

As to the fixing composition used in combination with the black-and-white developing composition, examples of the soluble compound include alkali metal sulfites, inorganic acids, aluminum compounds, and organic acids. Examples of the trace additive to form a coating layer include alkali metal iodides, coloring dyes, fixation promoters, image protective agents, and chelating agents. Preferred combinations are given below.

Combination C)

| Soluble compound | Trace additive |
|---|---|
| (1) Boric acid | KI |
| (2) Sodium sulfite | 2-dimethylaminoethyl isothiourea dihydrochloride |
| (3) Sodium acetate | Na-EDTA |

Also included are soluble compounds coated with a coloring layer as disclosed in Japanese Utility Model Publication No. 51160/1978.

A soluble compound can be coated with a substantially insoluble compound by dissolving the substantially insoluble compound in an organic solvent (e.g., methanol, acetone, ethyl acetate, ethylene glycol, and dimethylformamide) to form a solution of about 1% by weight, adding the soluble compound to the solution, and evaporating the solution to dryness with stirring. A trace additive may be coated in a similar manner by a choice of an organic solvent in which the additive is soluble.

The thus coated component generally contains a soluble compound and a coating compound in a weight ratio of from 20:1 to 5000:1 while a generally even coating layer is formed. The soluble compound forming the core generally has a particle size of about 20 to 1000 μm.

A layer containing the coated component is located in the layer arrangement as the layer to which the uncoated soluble component is originally assigned. The coated component may be either uniformly or locally distributed in the layer.

When a layer arrangement having a layer containing a soluble compound coated with a substantially insoluble compound is diluted with water to prepare a processing solution, the coating helps dissolve the substantially insoluble compound to form a homogeneous solution. In the case of a soluble compound coated with a trace additive, the coated component can be prepared in a large amount so that the quantity of the trace additive can be accurately metered. Therefore, the proportion of the trace additive per shot has a minimal shot-to-shot variation.

In a still further embodiment, a layer is composed of a solid or powder component having a liquid component added thereto.

The liquid component is a compound which is liquid under atmospheric pressure. Since it cannot form a layer as such, it is added to another solid component. Another requirement imposed on the liquid component used herein is that it is used in a processing solution in a minor amount of less than 10 grams/liter.

The solid component is a solid compound of which a layer can be solely formed. The liquid compound is added to the solid compound powder. Another requirement imposed on the solid component used herein is that it is used in a processing solution in a large amount, for example, from 40 to 300 grams/liter.

Further requirements are that the solid compound is substantially insoluble in the liquid compound, as expressed by a solubility of less than 0.1, and that they are not reactive upon contact.

By the term addition is meant that the liquid compound is mixed and dispersed in the solid compound powder, the liquid compound is covered with the solid compound powder, or the solid compound powder is impregnated with the liquid compound. Any of these states will occur depending on the nature and proportion of the two compounds and addition method. The mixture or dispersion may be a paste.

The liquid compound is generally added to the solid compound prior to formation of the solid component into a layer although the liquid compound can be added after the solid component is layered. Where a layer of a mixture or dispersion is stacked, it should be disposed adjacent a layer of a component which is not reactive with the solid and liquid compounds.

In the case of black-and-white developing compositions, the liquid compound used herein includes a development promoter in the form of an amine compound, a surfactant, and a defoaming agent.

Examples of the liquid amine compound include alkanolamines such as 6-dimethylamino-1-hexanol, N-methylaminoethanol, 3-diethylamino-1,2-propanediol, 2-aminoethylethanolamine, and butyldiethanolamine as disclosed in JP-A 106244/1981 and EP Publication No. 0136582.

The surfactants are nonionic surfactants, for example, surfactants having an ethylene oxide group as a hydrophilic group such as polyethylene glycol (trade name, Polyethylene Glycol-400, 1500 and 2000), polyoxyethylene alkyl ether and polyoxyethylene alkyl phenol having an ether type oleophilic group, and polyethylene glycol having an ester type oleophilic group. Also included are those having monoglyceride as a hydrophilic group. Further exemplary are trialkyl phosphates, especially those having a linear or branched alkyl group with 1 to 10 carbon atoms, typically an octyl group.

Silicone compounds are typical of the defoaming agents. Silicone L-76 (Nihon Unika K.K.) is a commercial example.

Examples of the solid compound available in powder form to which the liquid compound is added include hydroquinones and ascorbic acid derivatives used as a black-and-white developing agent; sulfites such as sodium sulfite, potassium sulfite, and sodium bisulfite used as a preservative; carbonates such as potassium carbonate and sodium carbonate, phosphates such as sodium phosphate, and organic acid salts such as sodium acetate, sodium citrate and sodium sulfonate used as a pH buffer agent; water-soluble polymers such as celluloses (e.g., hydroxyethyl cellulose and carboxymethyl cellulose) used as a thickener; and photographically inactive substances (e.g., saccharides) used in an intermediate layer interposed between solid state layers of interactive components of a photographic processing composition as previously described.

A solid compound and a liquid compound to be added thereto may be properly selected in any desired combination from the respective groups. Since a solid compound and a liquid compound to be added thereto are brought in contact, a combination that can offset their functions should be avoided. Exemplary preferred combinations are given below.

Combination D)

| Liquid compound | Solid compound |
|---|---|
| (1) 6-dimethylamino-1-hexanol | $K_2SO_3$ |
| (2) polyethylene glycol | hydroquinone |
| (3) butyldiethanolamine | $Na_2SO_3$ |
| (4) polyethylene glycol | saccharide |
| (5) 6-dimethylamino-1-hexanol | saccharide |
| (6) polyethylene glycol | $K_2SO_3$ |

Of course, the amine compounds used as a development promoter are converted into solid adducts using acids so that they may be formed into a layer according to the principle of the present invention. Therefore, adding a liquid compound to a solid compound is a secondary choice, but useful when the liquid compound is used in a too small amount to solely form a layer or when it is expensive or difficult to form an adduct.

The concept of adding a liquid compound to a solid compound to form a layer is also applicable to a fixing composition used in combination with the black-and-white developing composition.

The liquid compounds in the fixing composition include wetting aids or surfactants and defoaming agents while the solid compounds include thiosulfates, sulfites and organic acid salts (e.g., sodium acetate and sodium citrate) as well as photographically inactive substances (e.g., sodium sulfate).

Exemplary preferred combinations are given below.

Combination E)

| Liquid compound | Solid compound |
|---|---|
| (1) Polyethylene Glycol-400 | sodium thiosulfate |
| (2) Defoaming agent | sodium acetate |
| (3) Defoaming agent | sodium sulfate |

Since a layer can be formed simply by adding a liquid compound to powder, the operation is very simple. The addition of a liquid compound to powder gives a single mixture or dispersion which is convenient to handle.

EXAMPLE

Examples of the present invention are given below by way of illustration and not by way of limitation.

EXAMPLE 1

A black-and-white developer was composed of the following components. These components are available as powder or solid unless otherwise stated.

Alkaline agent:

-continued

| | |
|---|---|
| Potassium hydroxide | 580 g |
| pH buffer agent: | |
| Potassium bicarbonate | 150 g |
| Boric acid | 20 g |
| Antifoggant or development retarder: | |
| Potassium bromide | 80 g |
| 5-methylbenzotriazole | 1.2 g |
| 5-nitroindazole | 4.0 g |
| Preservative: | |
| Potassium sulfite | 885 g |
| Sodium bisulfite | 252 g |
| Hardener: | |
| Glutaraldehyde (liquid) | 100 g |
| Developing agent: | |
| Hydroquinone | 600 g |
| 1-phenyl-3-pyrazolidone | 36 g |
| Water softener or chelating agent: | |
| Diethylenetriaminepentaacetic acid | 30 g |

(1) Synthesis of GA-$NaHSO_3$ adduct

Glutaraldehyde-$NaHSO_3$ adduct abbreviated as GA-$NaHSO_3$ was synthesized according to the above-cited reference. This adduct had a molar ratio of 1:1.

(2) Preparation of 5-MBT coated KBr

In 150 ml of methanol was dissolved 1.2 grams of 5-methylbenzotriazole (5-MBT). 80 grams of potassium bromide (KBr) was added to the solution and mixed therewith by agitation. With stirring in a mixer/dryer, the mixture was evaporated to dryness. There was obtained KBr coated with 5-MBT. This coated product abbreviated as KBr/5-MBT had a weight ratio of 5-MBT to KBr of 1:67 corresponding to the mixing ratio.

(3) Preparation of 5-IND coated $H_3BO_3$

In 50 ml of methanol was dissolved 4.0 grams of 5-nitroindazole (5-IND). 20 grams of boric acid ($H_3BO_3$) was added to the solution. Following a drying procedure as in the preparation of KBr/5-MBT, there was obtained $H_3BO_3$ coated with 5-IND. This coated product abbreviated as $H_3BO_3$/5-IND had a weight ratio of 5-IND to $H_3BO_3$ of 1:5.

A vacuum package was prepared by successively introducing the foregoing components into a bag of polyethylene resin-coated aluminum foil (10 cm×15 cm×25 cm high) through its top opening to form a layer arrangement therein and sealing the bag of columnar shape at the inlet under vacuum. In this way, there were obtained Packages 1 to 3 of the following arrangement. The layers are described from the top to the bottom layer while the components were introduced from the one for the bottom layer to upper layers.

Package 1 (Invention)

(10) Diethylenetriaminepentaacetic acid
(9) Hydroquinone
(8) 1-phenyl-3-pyrazolidone
(7) Sodium bisulfite
(6) GA-$NaHSO_3$
(5) Potassium sulfite
(4) $H_3BO_3$/5-IND
(3) KBr/5-MBT
(2) Sodium bicarbonate
(1) Potassium hydroxide Package 2 (Invention)

(11) Diethylenetriaminepentaacetic acid
(10) Hydroquinone
(9) 1-phenyl-3-pyrazolidone
(8) GA-$NaHSO_3$
(7) Sodium bisulfite
(6) Glucose (30 g)
(5) Potassium sulfite
(4) $H_3BO_3$/5-IND
(3) KBr/5-MBT
(2) Sodium bicarbonate
(1) Potassium hydroxide Package 3 (Comparison)

(9) Diethylenetriaminepentaacetic acid
(8) Hydroquinone
(7) 1-phenyl-3-pyrazolidone
(6) Sodium bisulfite
(5) Potassium sulfite
(4) $H_3BO_3$/5-IND
(3) KBr/5-MBT
(2) Sodium bicarbonate
(1) Potassium hydroxide With Package 3, a separate polyethylene bottle was filled with 50% aqueous solution of glutaraldehyde.

For comparison purpose, a package was prepared by previously blending all the components, charging a bag with the mixture, and sealing the bag under vacuum. This is designated Package 4.

Package 4 (Comparison)

Diethylenetriaminepentaacetic acid
Hydroquinone
1-phenyl-3-pyrazolidone
Potassium sulfite
$H_3BO_3$/5-IND
KBr/5-MBT
Sodium bicarbonate
Potassium hydroxide
GA-$NaHSO_3$
Sodium bisulfite Also for comparison purpose, a bottle assembly was prepared by blending the following components into liquid parts A, B and C and filling polyethylene bottles with liquid parts A, B and C, respectively, the bottles being combined into an assembly. This is designated Package 5.

Package 5 (Comparison)

Part A
- Hydroquinone
- Sodium bisulfite
- Potassium sulfite
- Boric acid
- Sodium bicarbonate
- Potassium hydroxide
- 5-MBT Part B
- 1-phenyl-3-pyrazolidone
- 5-IND Part C
- Glutaraldehyde (50% aqueous solution)

Packages 1 to 5 were stored for 4 weeks at a temperature of 50° C. and a relative humidity of 70% before their contents were dissolved in water to a total volume of 20 liters. For Packages 1 to 3, each layered block was introduced into water from the top layer side. The thus prepared solutions corresponding to Packages 1 to 5 are designated Developers I to V, respectively.

Next, strips of black-and-white X-ray photosensitive material RX commercially available from Fuji Photo-Film Co., Ltd., after exposure, were processed according to the following schedule using a roller transport type automatic processor FPM-3000 commercially available from Fuji Photo-Film Co., Ltd.

| Step | Time | Temperature |
|---|---|---|
| Black-and-white development | 25 sec. | 35° C. |
| Fixation | 20 sec. | 33° C. |
| Washing | 11 sec. | 20° C. |
| Drying | 25 sec. | 55° C. |

The development step used Developers I to V.

The fixing and washing steps used the following fixing and washing solutions.

| | |
|---|---|
| Fixer | |
| Disodium ethylenediaminetetraacetate | 0.05 g |
| Ammonium thiosulfate (70 wt/vol %) | 200 ml |
| Sodium thiosulfate | 30 g |
| Sodium sulfite | 20 g |
| Boric acid | 8 g |
| Glacial acetic acid | 20 g |
| Tartaric acid | 1 g |
| Aluminum sulfate | 15 g |
| Water | totaling to 1 liter |
| | pH 4.5 |
| Wash water | |
| City water | |

A fresh developer was prepared as a reference developer by dissolving the above-listed components (which had been kept fresh in isolate form) in water to a total volume of 20 liters. It is to be noted that 5-methylbenzotriazole and 5-nitroindazole were first dissolved in methanol and then added to the developer so that the developer became uniform. Using the reference developer, a film was also processed according to the above schedule (reference sample).

The developers were at about pH 10.5.

The X-ray films processed with the respective Developers I to V were evaluated for processing and photographic factors. The results are shown in Table 1.

Washing factor:

Washing factor was represented by the amount of residual hypo or yellow density (see Kikuchi et al., "Kagaku Shashin Benran (Manual of Scientific Photography)", Maruzen, 1964, page 21).

Dryness:

The processed film at the outlet of the processor was examined for dryness through tactile impression.

Photographic sensitivity:

Photographic sensitivity at a density D of 1.5 was measured and expressed as a relative value based on a sensitivity of 100 for the reference sample.

TABLE 1

| Package | Developer | Processing factor Wash | Processing factor Dryness | Photographic Sensitivity | Remarks |
|---|---|---|---|---|---|
| 1 | I | 0.02 | Complete dry | 100 | |
| 2 | II | 0.02 | Complete dry | 100 | |
| 3* | III | 0.02 | Complete dry | 100 | 2 parts; lot-to-lot variation in sensitivity among several lots tested |
| 4* | IV | 0.21 | Wet | 60 | Massive, color change |
| 5* | V | 0.04 | Dry | 95 | 3 parts; lot-to-lot variation in sensitivity among several lots tested |
| Reference developer | | 0.02 | Dry | 100 | |

*outside the scope of the invention

Developers I and II were easy to prepare from the corresponding packages, consistent in processing capability from lot to lot, and equally effective in photographic property to the reference developer.

Developers III and V were cumbersome to prepare because the aldehyde was charged in the separate container. Some of them showed a substantial lot-to-lot variation in processing capability due to leakage during storage or spillage upon preparation. Developer IV was easy to prepare, but Package 4 was poor in storage stability, allowing the contents to change their color and become massive.

EXAMPLE 2

A black-and-white developer was composed of the following components. These components are available as powder or solid unless otherwise stated.

| | |
|---|---|
| Alkaline agent: | |
| Sodium hydroxide | 110 g |
| Antifoggant: | |
| Potassium bromide | 12 g |
| 5-methylbenzotriazole | 0.5 g |
| Preservative: | |
| Potassium sulfite | 560 g |
| Sodium sulfite | 920 g |
| Development promoter: | |
| N-methylaminoethanol (liquid) | 50 g |
| Developing agent: | |
| Hydroquinone | 450 g |
| N-methylaminophenol (liquid) | 47 g |
| Chelating agent: | |
| Disodium ethylenediaminetetraacetate | 15 g |

KBr coated with 5-methylbenzotriazole (5-MBT) was prepared as in Example 1.

The liquid components, N-methylaminoethanol and N-methylaminophenol were converted into solid form by forming their adducts, N-methylaminoethanol-HCl and N-methylaminophenol-$\frac{1}{2}H_2SO_4$, respectively. To compensate for a pH change due to the acids used to form the adducts, the amount of alkali was adjusted so as to achieve a desired pH.

A vacuum package was prepared by successively introducing the foregoing components into a bag of polyethylene resin-coated aluminum foil (10 cm×15 cm×20 cm high) through its top opening to form a layer arrangement therein and sealing the bag at the inlet under vacuum. In this way, there were obtained Packages a and b of the following arrangement. The layers are described from the top to the bottom layer while the components were introduced from the one for the bottom layer to upper layers.

Package a (Invention)

(8) Disodium ethylenediaminetetraacetate
(7) Hydroquinone
(6) N-methylaminophenol-$\frac{1}{2}H_2SO_4$
(5) Potassium sulfite
(4) N-methylaminoethanol-HCl
(3) Sodium sulfite
(2) KBr/5-MBT
(1) Potassium hydroxide Package b (Comparison)

(7) Disodium ethylenediaminetetraacetate
(6) Hydroquinone
(5) N-methylaminophenol-$\frac{1}{2}H_2SO_4$
(4) Potassium sulfite
(3) Sodium sulfite
(2) KBr/5-MBT
(1) Potassium hydroxide With Package b, a separate polyethylene bottle was filled with N-methylaminoethanol.

For comparison purpose, a package was prepared by previously blending all the components, charging a bag with the mixture, and sealing the bag under vacuum. This is designated Package c.

Package c (Comparison)

Disodium ethylenediaminetetraacetate
Hydroquinone
N-methylaminophenol-$\frac{1}{2}H_2SO_4$
Potassium sulfite
Sodium sulfite
KBr/5-MBT
N-methylaminoethanol-HCl
Potassium hydroxide Packages a to c were stored for 4 weeks at a temperature of 50° C. and a relative humidity of 70% before their contents were dissolved in water to a total volume of 10 liters. The thus prepared solutions corresponding to Packages a to c are designated Developers A to C, respectively. Developers A to C were at pH 11.0.

Next, strips of mini-copy film HRII, photosensitive material commercially available from Fuji Photo-Film Co., Ltd., after exposure, were processed according to the following schedule using an automatic processor Model Cordell 642 commercially available from Cordel Co.

| Step | Time | Temperature |
|---|---|---|
| Black-and-white development | 10 sec. | 43° C. |
| Fixation | 10 sec. | 25° C. |
| Washing | 10 sec. | 25° C. |
| Drying | 10 sec. | 60° C. |

The development step used Developers A to C.

The fixing and washing steps used a fixer MF-585 commercially available from Fuji Photo-Film Co., Ltd. and flowing water (city water), respectively.

A fresh developer was prepared as a reference developer by dissolving the above-listed components (which had been kept fresh in isolate form) in water to a total volume of 10 liters. It is to be noted that 5-methylbenzotriazole was first dissolved in methanol and then added to the developer so that the developer became uniform.

Using the reference developer, film was also processed according to the above schedule (reference sample).

Films processed with the respective Developers A to C were evaluated for photographic sensitivity and expressed as a relative value based on a sensitivity of 100 for the reference sample. The results are shown in Table 2.

TABLE 2

| Package | Developer | Sensitivity | Remarks |
|---|---|---|---|
| a | A | 100 | |
| b* | B | 100 | 2 parts; lot-to-lot variation in sensitivity among several lots tested |
| c* | C | 75 | Color change |
| Reference developer | | 100 | |

*outside the scope of the invention

Developer A was easy to prepare from the corresponding package, consistent in processing capability from lot to lot, and equally effective in photographic property to the reference developer.

Developer B was cumbersome to prepare because the liquid promoter (N-methylaminoethanol) was charged in the separate container. It showed a substantial lot-to-lot variation in photographic sensitivity. Developer C showed a substantial loss of photographic sensitivity because Package c was poor in storage stability as evident from a color change.

There has been described a vacuum package of a photographic processing composition consisting of components which are received in a container as separate solid state layers in a vacuum sealed manner, wherein a normally liquid component is converted into a solid adduct for containment. The layered arrangement is effective for preventing deterioration during storage and easier to handle. It can be readily diluted with water to form a processing solution of consistent quality to ensure production of images with improved photographic properties. The package is compact and advantageous in transportation cost and storage.

Although some preferred embodiments have been described, many modifications and variations may be made thereto in the light of the above teachings. It is therefore to be understood that within the scope of the appended claims, the invention may be practiced otherwise than as specifically described.

We claim:

1. A vacuum packaged photographic processing composition consisting of a plurality of photographic processing components which are received in a container and vacuum sealed, said plurality of components are contained in separate solid state layers, wherein at least one of said plurality of components includes a normally liquid component which is converted into a solid adduct for containment.

2. The vacuum packaged photographic processing composition of claim 1 wherein the normally liquid component is a carbonyl compound.

3. The vacuum packaged photographic processing composition of claim 2 wherein the carbonyl compound is converted into a solid adduct with a sulfite.

4. The vacuum packaged photographic processing composition of claim 1 wherein the normally liquid component is an amine compound.

5. The vacuum packaged photographic processing composition of claim 4 wherein the amine compound is converted into a solid adduct with an acid.

6. The vacuum packaged photographic processing composition of claim 1 wherein an inert layer intervenes between layers of components which can give rise to solid phase reaction if kept in contact.

7. The vacuum packaged photographic processing composition of claim 1 wherein at least one component is coated on the surface of particles of a water soluble inorganic compound.

8. The vacuum packaged photographic processing composition of claim 7 wherein said component to be coated is a substantially water insoluble compound or a trace additive.

9. The vacuum packaged photographic processing composition of claim 1 which is a black-and-white developing composition.

10. The vacuum packaged photographic processing composition of claim 9 wherein the composition includes an alkaline agent, a preservative, a developing agent, and a chelating agent which are stacked as respective layers in the described order.

11. A vacuum package comprising a container and a photographic processing composition consisting of a plurality of photographic processing components which are received in the container and vacuum sealed, said plurality of components are contained in separate solid state layers, wherein at least one of said plurality of components includes a normally liquid component which is converted into a solid adduct for containment.

12. The vacuum package of claim 11 wherein the normally liquid component is a carbonyl compound.

13. The vacuum package of claim 12 wherein the carbonyl compound is converted into a solid adduct with a sulfite.

14. The vacuum package of claim 11 wherein the normally liquid component is an amine compound.

15. The vacuum package of claim 14 wherein the amine compound is converted into a solid adduct with an acid.

16. The vacuum package of claim 11 wherein an inert layer intervenes between layers of components which can give rise to a solid phase reaction if kept in contact.

17. The vacuum package of claim 11 wherein at least one component is coated on the surface of particles of a water soluble inorganic compound.

18. The vacuum package of claim 17 wherein said component to be coated is a substantially water insoluble compound or a trace additive.

19. The vacuum package of claim 11 wherein the composition is a black-and-white developing composition.

20. The vacuum package of claim 19 wherein the composition includes an alkaline agent, a preservative, a developing agent, and a chelating agent which are stacked as respective layers in the described order.

21. The vacuum package of claim 11 which is of columnar shape.

22. A vacuum packaged photographic processing composition consisting of a plurality of photographic processing components which are received in a container and vacuum sealed, said plurality of components are contained in separate solid state layers, wherein at least one of said plurality of components is coated on a surface of particles of a water soluble inorganic compound.

23. The vacuum packaged photographic processing composition of claim 22 wherein the composition is a black-and-white developing composition.

24. The vacuum packaged photographic processing composition of claim 23 wherein said component to be coated is a substantially water insoluble inorganic compound having a solubility of up to 0.1 grams/100 ml of water.

25. The vacuum packaged photographic processing composition of claim 24 wherein said substantially water insoluble inorganic compound is selected from the group consisting of mercapto, indazole and benzotriazole compounds as an antifoggant, pigments, fluorocarbon compounds as a defoaming agent, brighteners, pyrazolidone compounds as an auxiliary developing agent.

26. The vacuum packaged photographic processing composition of claim 23 wherein said component to be coated is a trace additive which is added in an amount of up to 0.3% by weight of the composition.

27. The vacuum packaged photographic processing composition of claim 23 wherein said water soluble inorganic compound has a solubility of at least 10 grams/100 ml of water.

28. The vacuum packaged photographic processing composition of claim 27 wherein said water soluble inorganic compound is selected from the group consisting of alkali metal halides as an antifoggant or development retarder, alkali metal sulfites as a preservative, alkali metal carbonates as a pH buffer agent, alkali metal phosphates, and boric acid.

29. A vacuum package comprising a container and a photographic processing composition consisting of a plurality of photographic processing components which are received in the container and vacuum sealed, said plurality of components are contained in separate solid state layers, wherein at least one of said plurality of components is coated on a surface of particles of a water soluble inorganic compound.

30. The vacuum package of claim 29 wherein the composition is a black-and-white developing composition.

31. The vacuum package of claim 30 wherein said component to be coated is a substantially water insoluble inorganic compound having a solubility of up to 0.1 grams/100 ml of water.

32. The vacuum package of claim 31 wherein said substantially water insoluble inorganic compound is selected from the group consisting of mercapto, indazole and benzotriazole compounds as an antifoggant, pigments, fluorocarbon compounds as a defoaming agent, brighteners, pyrazolidone compounds as an auxiliary developing agent.

33. The vacuum package of claim 30 wherein said component to be coated is a trace additive which is added in an amount of up to 0.3% by weight of the composition.

34. The vacuum package of claim 30 wherein said water soluble inorganic compound has a solubility of at least 10 grams/100 ml of water.

35. The vacuum package of claim 34 wherein said water soluble inorganic compound is selected from the group consisting of alkali metal halides as an antifoggant or development retarder, alkali metal sulfites as a preservative, alkali metal carbonates as a pH buffer agent, alkali metal phosphates, and boric acid.

36. The vacuum package of claim 29 which is of columnar shape.

37. The vacuum packaged photographic processing composition of claim 2, wherein the adduct is selected from the group consisting of formaldehyde-$NaHSO_3$, glutaraldehyde-$NaHSO_3$, acetone-$NaHSO_3$ and acetoaldehyde-$KHSO_3$.

38. The vacuum packaged photographic processing composition of claim 4, wherein the adduct is selected from the group consisting of p-aminophenol-HCl, diethanolamine-$HNO_3$, N-butyldiethanolamine-$(COOH)_2$, 6-dimethylamino-1-hexanol-succinic acid, methylaminoethanol-HCl and N-methylaminophenol-$H_2SO_4$.

39. The vacuum package of claim 12, wherein the adduct is selected from the group consisting of formaldehyde-$NaHSO_3$, glutaraldehyde-$NaHSO_3$, acetone-$NaHSO_3$ and acetoaldehyde-$KHSO_3$.

40. The vacuum package of claim 14, wherein the adduct is selected from the group consisting of p-aminophenol-HCl, diethanolamine-$HNO_3$, N-butyldiethanolamine-$(COOH)_2$, 6-dimethylamino-1-hexanol-succinic acid, methylaminoethanol-HCl and N-methylaminophenol-$H_2SO_4$.

41. The vacuum packaged photographic processing composition of claim 38, wherein the amine compounds and the acids form adducts in a molar ratio of from 2:1 to 1:2.

42. The vacuum package of claim 40, wherein the amine compounds and the acids form adducts in a molar ratio of from 2:1 to 1:2.

43. The vacuum packaged photographic processing composition of claim 6, wherein the inert substance of the inert layer:

(1) does not function as a component of the photographic processing composition,
(2) is inert to the components of adjoining layers, and
(3) does not substantially alter the photographic capability of a processing solution obtained by diluting the composition with water.

44. The vacuum packaged photographic processing composition of claim 6, wherein the inert substance of the inert layer:

(1) does not function as a component of the photographic processing composition,
(2) is inert to the components of the composition, and
(3) does not substantially alter the photographic capability of a processing solution obtained by diluting the composition with water.

45. The vacuum package of claim 16, wherein the inert substance of the inert layer:

(1) does not function as a component of the photographic processing composition,
(2) is inert to the components of adjoining layers, and
(3) does not substantially alter the photographic capability of a processing solution obtained by diluting the composition with water.

46. The vacuum package of claim 16, wherein the inert substance of the inert layer:

(1) does not function as a component of the photographic processing composition,
(2) is inert to the components of the composition, and
(3) does not substantially alter the photographic capability of a processing solution obtained by diluting the composition with water.

* * * * *